US006271635B1

(12) United States Patent
Daniel

(10) Patent No.: US 6,271,635 B1
(45) Date of Patent: Aug. 7, 2001

(54) DIMMING SYSTEM AND METHOD FOR MAGNETICALLY BALLASTED GASEOUS DISCHARGE LAMPS

(75) Inventor: Edmond Daniel, Bensenville, IL (US)

(73) Assignee: Advanced Lighting Technologies, Inc., Solon, OH (US)

( * ) Notice: Subject to any disclaimer, the term of this patent is extended or adjusted under 35 U.S.C. 154(b) by 0 days.

(21) Appl. No.: 09/227,830

(22) Filed: Jan. 11, 1999

(51) Int. Cl.[7] ..... H05B 41/16
(52) U.S. Cl. ..... 315/277; 315/291; 315/DIG. 4
(58) Field of Search ..... 315/277, 276, 315/278, 269, 291, 297, 220, 224, DIG. 4, 281, 282

(56) References Cited

U.S. PATENT DOCUMENTS

| | | | | |
|---|---|---|---|---|
| 2,593,651 | * | 4/1952 | Bird | 315/291 |
| 3,631,527 | * | 12/1971 | Splain | 315/276 |
| 3,816,794 | * | 6/1974 | Snyder | 315/194 |
| 4,181,873 | * | 1/1980 | Nuver | 315/291 |
| 4,189,664 | * | 2/1980 | Hirschfeld | 315/276 |
| 4,197,485 | * | 4/1980 | Nuver | 315/291 |
| 4,434,388 | * | 2/1984 | Carver et al. | 315/307 |
| 4,443,740 | * | 4/1984 | Goralnik | 315/284 |
| 4,891,562 | * | 1/1990 | Nuckolls et al. | 315/277 |
| 4,931,701 | * | 6/1990 | Carl | 315/240 |
| 5,216,333 | * | 6/1993 | Nuckolls et al. | 315/291 |
| 5,477,113 | * | 12/1995 | Christoffersson | 315/278 |
| 5,550,437 | * | 8/1996 | Hopkins et al. | 315/209 R |
| 5,663,612 | * | 9/1997 | Nuckolls | 315/240 |

* cited by examiner

*Primary Examiner*—Haissa Philogene
*Assistant Examiner*—Ephrem Alemu
(74) *Attorney, Agent, or Firm*—Carter, Ledyard & Milburn

(57) ABSTRACT

A dimming system and method suitable for any type of magnetic ballast operating a gaseous discharge lamp. The dimming system operates to selectively vary the number of turns of the ballast winding in operative connection with the lamp to thereby effect a change in the impedance of the ballast, the power provided to the lamp, and ultimately the brightness of the lamp. The system may be operated such that the brightness of the lamp is selected responsive to the detection of an external stimulus such as motion or sound within the space to be illuminated.

62 Claims, 3 Drawing Sheets

DIMMING SYSTEM AND METHOD FOR MAGNETICALLY BALLASTED GASEOUS DISCHARGE LAMPS

BACKGROUND OF THE INVENTION

The present invention relates to magnetic ballasts for operating gaseous discharge lamps such as high intensity discharge ("HID") lamps or fluorescent lamps. More particularly, the invention relates to such ballasts which selectively operate the lamps in a reduced light-output or dim mode.

Gaseous discharge lamps such as HID lamps have found widespread acceptance in lighting large outdoor and indoor areas such as athletic stadiums, gymnasiums, warehouses, parking facilities, and the like, because of the relatively high efficiency and low maintenance of HID lamps when compared to other lamp types such as incandescent lamps. When lighting such large areas, there are a number of circumstances in which full illumination of the area is not necessary. For example, in an area which is occupied sporadically, in order to save energy, it is desirable to illuminate the lamps only when the space is sensed to be occupied. The lamps may be extinguished when the space is sensed to be unoccupied, however, because of the slow starting characteristics of HID lamps from an extinguished condition, it is desirable to operate the lamps in a dim mode when full illumination is not desired.

The starting and operating characteristics of HID lamps require the lamps to be operated from a ballast which regulates the lamp operating current and wattage. One common type of ballast used to operate HID lamps is the magnetic ballast comprising a magnetic core having two windings, a first winding connected to an a.c. power source and a second winding connected to the lamp.

In order to operate the lamp in a dim mode from such a magnetic ballast, dimming circuits are used to effect a reduction in power provided by the ballast to the lamp when desired. One type of magnetic ballast commonly used to operate HID lamps is the constant wattage autotransformer. In the constant wattage autotransformer, the two windings of the ballast are capacitively connected. One prior art dimming circuit used with a constant wattage autotransformer operates to switch one or more capacitors either in series with or parallel to the capacitor connecting the windings to alter the impedance of the ballast. Altering the impedance of the ballast effects a change in the power provided to the lamp which thereby effects a change in the brightness of the lamp.

The prior art dimming circuit uses a relay to switch the capacitors into or out of the ballast. One disadvantage of this prior art dimming circuit is that the relay is exposed to high inrush currents, typically about 700 amps, during operation of the circuit. Thus the operating life of the relay is reduced unless a current protection means is added to the dimming circuit. Further, such dimming circuits require the addition of one or more capacitors to the ballast thus raising the manufacturing costs of the ballast. Such prior art dimming circuits are only suitable for use with magnetic ballasts such as the constant wattage autotransformer wherein the windings are capacitively connected.

Another prior art dimming circuit operates with a third winding coupled to the magnetic core. The third winding selectively operates to shunt magnetic flux away from the winding connected to the lamp to thereby reduce the power provided to the lamp. Such prior art dimming circuits are not energy efficient because some power provided to the ballast is shunted away from the lamp. Further, the dimming circuit requires the addition of a winding to the ballast thus adding to the manufacturing costs of the ballasts.

Accordingly, it is an object of the present invention to provide a novel dimming circuit and novel dimming method for a magnetically ballasted HID lamp which obviates the deficiencies of known dimming circuits.

It is another object of the present invention to provide a novel dimming circuit and a novel dimming method for a magnetically ballasted HID lamp which is suitable for use with any type of magnetic ballast.

It is yet another object of the present invention to provide a novel dimming circuit and a novel dimming method for a magnetically ballasted HID lamp which selectively operates the lamp in a dim mode.

It is still another object of the present invention to provide a novel dimming circuit and a novel dimming method for a magnetically ballasted HID lamp which selectively alters the impedance of the ballast to effect a change in the brightness of the lamp.

It is a further object of the present invention to provide a novel dimming circuit and a novel dimming method which may be used with a plurality of magnetically ballasted HID lamps.

It is yet a further object of the present invention to provide a novel dimming circuit and a novel dimming method for a magnetically ballasted HID lamp which selectively operates the lamp in a bright mode responsive to an external stimulus such as the detection of motion or sound.

It is still a further object of the present invention to provide a novel dimming circuit and a novel dimming method for a magnetically ballasted HID lamp which operates the lamp in a bright mode for a predetermined time after power is applied to the ballast, then selectively operates the lamp in a bright mode responsive to the detection of an external stimulus.

These and many other objects and advantages of the present invention will be readily apparent to one skilled in the art to which the invention pertains from a perusal of the claims, the appended drawings, and the following detailed description of the preferred embodiments.

DESCRIPTION OF PREFERRED EMBODIMENTS

Figure 1:
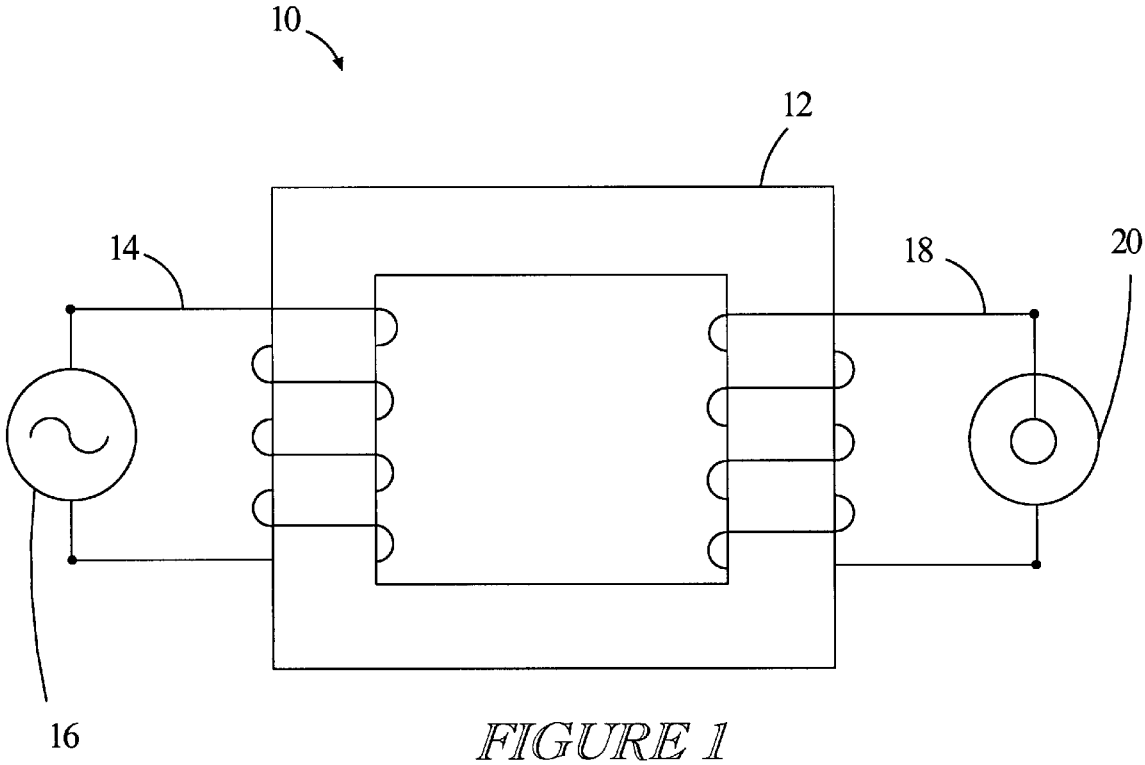
FIGURE 1 (PRIOR ART)
FIG. 1 is a simplified circuit diagram of a prior art magnetic ballast.

The present invention is suitable as a dimming circuit for an HID lamp operated from any magnetic ballast having a core and one or more windings, e.g., a reactor, high reactance autotransformer, constant wattage autotransformer, constant wattage and regulated lag ballasts. FIG. 1 illustrates a typical magnetic ballast for operating an HID lamp. With reference to FIG. 1, the ballast 10 comprises a core 12 which magnetically couples a first winding 14 connected to an a.c. power source 16, and a second winding 18 connected to an HID lamp 20. The output or brightness of the lamp 20 at any lamp voltage is directly proportional to the lamp current. The lamp current is inversely proportional to the impedance of the ballast 10 which is a function of the number of turns of the winding 18. Thus varying the number of turns in the winding 18 will vary the brightness of the lamp 20.

The specific relationship between the change in the number of turns in the winding 18 and the change in brightness of the lamp 20 is different for the different types of magnetic ballasts. For example, in some types of magnetic ballasts such as the constant wattage autotransformer, a reduction in the number of turns in the winding 18 effects a reduction in the brightness of the lamp 20, while in other types of magnetic ballasts such as the high reactance autotransformer, a reduction in the number of turns of the winding 18 effects an increase in the brightness of the lamp 20.

Figure 2:
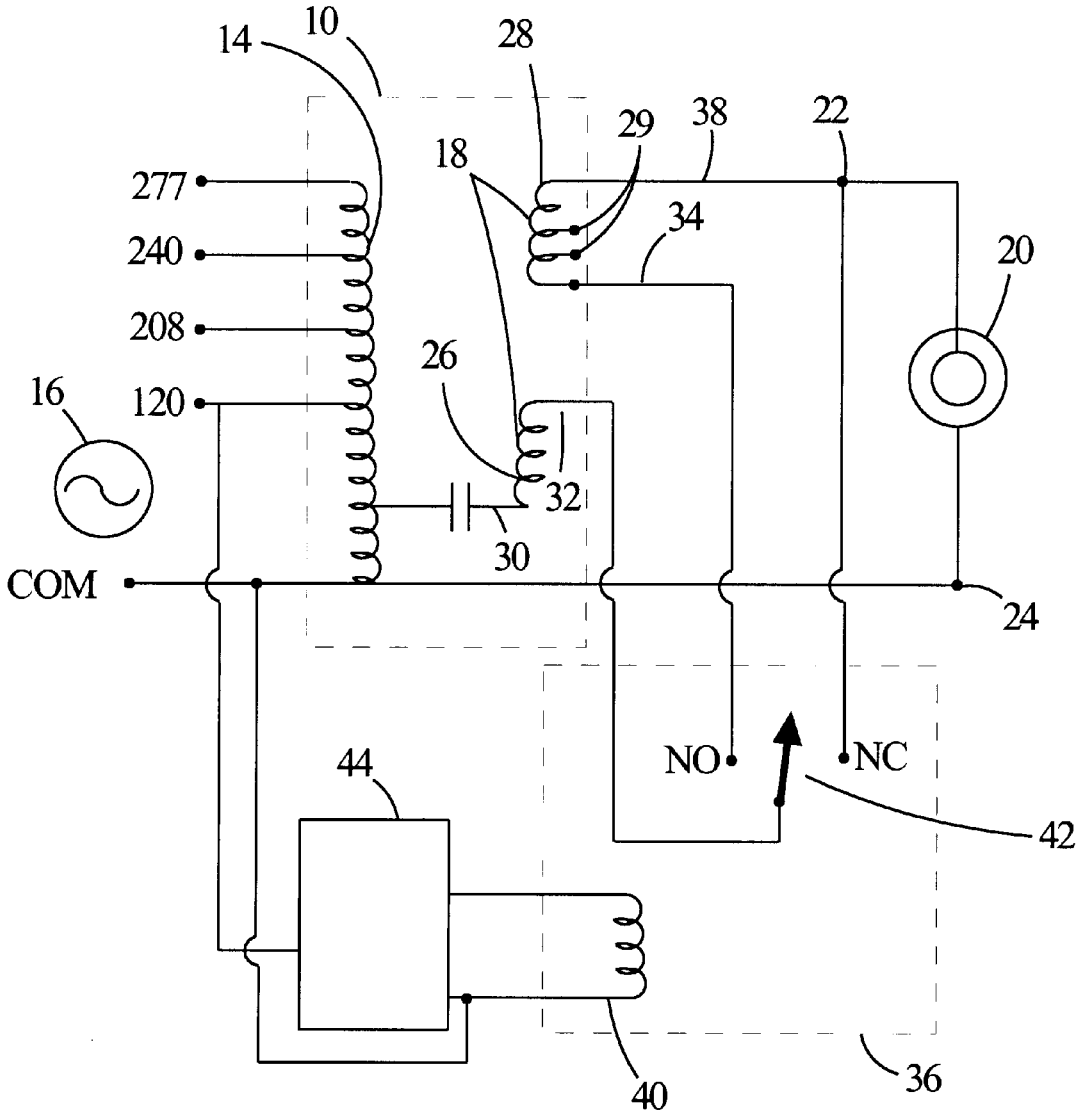
FIG. 2 is a circuit diagram of one embodiment of the present invention.

While of utility with any type of magnetic ballast, the present invention may be easily understood in the embodiment of the dimming circuit for an HID lamp ballasted from a constant wattage autotransformer as shown in FIG. 2. With reference to FIG. 2, the ballast 10 comprises the first winding 14 connected to the a.c. power source 16, and the second winding 18 connected to the HID lamp 20 at a first lamp terminal 22 and a second lamp terminal 24. The winding 14 may be adapted for connection to an a.c. power source 16 supplying an a.c. voltage of any value but typically between 120–480 volts a.c. As shown, the winding 14 includes input voltage taps at 120, 208, 240, and 277 volts a.c. power at a voltage from 120 volts a.c. to 277 volts a.c. HID lamp 20 may be any type of HID lamp such as a metal halide, high pressure sodium lamp, low pressure sodium, or mercury lamps.

The winding 18 comprises a first portion 26 and a second portion 28. The first winding portion 26 is connected at one end 30 to the second lamp terminal 24. The other end 32 of the winding portion 26 is connected to either the first lamp terminal 22 or to one end 34 of the second winding portion 28 through the two position switch 36. The second winding portion 28 is connected at one end 38 to the first lamp terminal 22. The other end 34 of the winding portion 28 is connectable to one end 32 of winding portion 26 through switch 36.

The switch 36 is a two position switch connecting the end 32 of the first winding portion 26 to (1) the end 34 of the second winding portion 28 to thereby connect the lamp 20 in series with winding portions 26,28, and (2) the first lamp terminal 22 to thereby connect the lamp 20 in series with the first winding portion 26. The winding portion 28 may be removed from operative connection to the lamp 20 and the first winding portion 26 to thereby reduce the number of turns of the winding 18 in operative connection with the lamp 20. Thus the number of turns of winding 18 in operative connection to the lamp 20 may be selectively varied between the number of turns in winding portions 26,28 and the number of turns in winding portion 26 alone.

The number of turns in winding portion 28 may be selectively varied to vary the magnitude of the change in ballast impedance when the winding portion 28 is removed from operative connection with the lamp 20. The winding taps 29 are one means to vary the number of turns in winding 28.

The change in the number of turns of winding 18 in operative connection with the lamp 20 results in a change in the impedance in the ballast 10 which thereby effects a change in the brightness of the lamp 20. In the embodiment of the present invention disclosed in FIG. 2, a reduction in the number of turns of winding 18 in operable connection with the lamp 20 effects an increase in the impedance of the ballast 10 which thereby effects a reduction in the brightness of the lamp 20. Thus the lamp 20 may be operated (1) in a dim mode with the switch 36 positioned to connect the end 32 of the first winding portion 26 to the first lamp terminal 22, and (2) in a bright mode with the switch 36 positioned to connect the end 32 of the first winding portion 26 to the end 34 of the second winding portion 28.

The switch 36 may be operated mechanically by manually positioning the switch 36 to operate the lamp in the desired mode. In circumstances where the illuminated space is sporadically occupied, it is desirable to operate the lamp in a bright mode only when the space is occupied without requiring manual positioning of the switch 36. Accordingly, the switch 36 may be selectively operated responsive to the detection of an external stimulus indicating that the space is occupied, e.g., motion or sound. In the embodiment of FIG. 2, the switch 36 comprises an electromagnetic dimming relay 40 and dimming relay contacts 42. The relay contacts 42 are normally closed when relay 40 is deenergized to connect the end 32 of winding portion 26 to the first lamp terminal 22 to thereby effect illumination of the lamp 20 in a dim mode. The relay 40 is energized to position the relay contacts 42 to connect the end 32 of winding portion 26 to the end 34 of the winding portion 28 to thereby effect illumination of the lamp 20 in a bright mode.

The relay 40 is energized responsive to the detection of an external stimulus. In the embodiment of FIG. 2, the motion detector 44 may be any conventional motion detector and operates to energize the relay 40 responsive to the detection of motion, and to deenergize the relay 40 when motion is no longer detected. Thus the lamp 20 is illuminated in a bright mode when motion is detected, and illuminated in a dim mode when motion is not detected. The detector 44 may operate with a time delay to delay the deenergization of the relay 40 for a predetermined time after motion is no longer detected.

Figure 3:
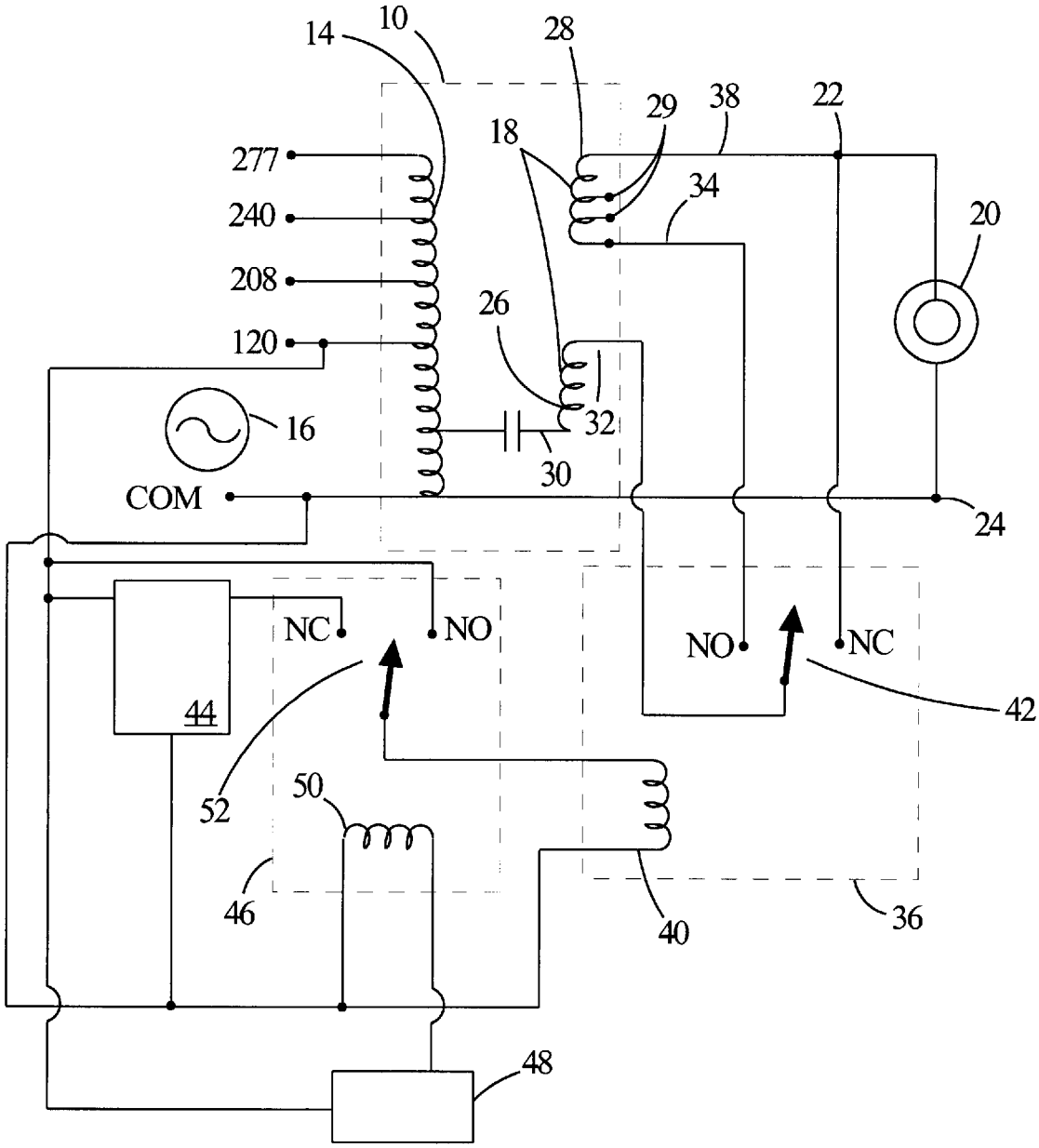
FIG. 3 is a circuit diagram of a second embodiment of the present invention.

FIG. 3 shows another embodiment of the present invention. With reference to FIG. 3, the dimming circuit may further comprise a starting circuit for effecting the illumination of the lamp 20 in a bright mode for a predetermined time after the lamp 20 is illuminated from an extinguished condition. The starting circuit thus allows the lamp 20 to operate in a stable arc condition before being operated in the dim mode.

The starting circuit comprises a two position switch 46 and a timing circuit 48. The switch 46 is positionable to energize relay 40 (1) directly from the a.c. power source 16, or (2) from the a.c. power source 16 through the motion detector 44. Thus the switch.46 may be positioned to bypass the motion detector to thereby energize the relay 40 and effect the illumination of the lamp 20 in a bright mode independently from the detection of motion. The switch 46 comprises an electromagnetic starting relay 50 and starting relay contacts 52. The relay contacts 52 are positioned to energize the dimming relay 40 from the a.c. power source 16 through the motion detector 44 when the starting relay 50 is deenergized. The starting relay 50 is energized to position the relay contacts 52 to energize the dimming relay 40 directly from the a.c. power source 16, bypassing the motion detector 44.

The starting relay 50 is energized from the a.c. power source 16 through the timing circuit 48 when the a.c. power is applied to the ballast 10. The timing circuit 48 may be any conventional timing circuit and operates to deenergize the starting relay 50 when the a.c. power has been applied to the ballast 10 for a predetermined time. Thus the starting circuit effects the operation of the lamp 20 at the full power provided from both winding portions 26,28 to thereby effect a stable arc condition in the lamp 20 when illuminated from an extinguished condition before the lamp 20 may be operated in a dim mode.

While preferred embodiments of the present invention have been described, it is to be understood that the embodiments described are illustrative only and the scope of the invention is to be defined solely by the appended claims when accorded a full range of equivalence, many variations and modifications naturally occurring to those of skill in the art from a perusal hereof.

What is claimed is:

1. A gaseous discharge lamp ballast comprising:

(a) a magnetic core;

(b) a power winding coupled to said magnetic core and being adapted for connection to an a.c. power source;

(c) a lamp winding coupled to said magnetic core and connected to the lamp;

(d) a dimming winding coupled to said magnetic core; and (e) switch means for selectively connecting said dimming winding in series with the lamp and said lamp winding to effect a change in the impedance of the ballast to thereby effect a change in the power provided to the lamp at a substantially constant voltage to thereby effect sustained illumination of the lamp in a bright mode or in a dim mode.

2. The ballast of claim 1 wherein said dimming winding is connected in series with said lamp winding and the lamp to effect the operation of the lamp in a bright mode.

3. The ballast of claim 1 wherein said dimming winding is connected in series with said lamp winding and the lamp to effect the operation of the lamp in a dim mode.

4. The ballast of claim 1 wherein said ballast is a constant wattage autotransformer magnetic ballast.

5. The ballast of claim 1 wherein said secondary winding is connected to a metal halide lamp.

6. The ballast of claim 1 wherein the lamp is a gaseous discharge lamp from selected from the group consisting of metal halide lamps, high pressure sodium lamps, low pressure sodium lamps, mercury lamps, and fluorescent lamps.

7. The ballast of claim 1 wherein said power winding is adapted for connection to an a.c. power source having a voltage within the range of voltages from 120 volts to 277 volts.

8. The ballast of claim 7 wherein said power winding is adapted for connection to a 120 volt a.c. power source.

9. The ballast of claim 1 further comprising a means for controlling the magnitude of dimming.

10. The ballast of claim 9 wherein said means for controlling the magnitude of dimming comprises a rheostat.

11. The ballast of claim 9 wherein said means for controlling the magnitude of dimming comprises a tapped dimming winding.

12. The ballast of claim 1 further comprising a starting circuit means for operating said switch means to effect the operation of said lamp in a bright mode for a predetermined time after the a.c. power is applied to the ballast.

13. The ballast of claim 12 further comprising a control means for controlling the operation of said switch means after said predetermined time after the a.c. power is applied to the ballast.

14. The ballast of claim 13, wherein said starting circuit means and said control means are common to a plurality of ballasts.

15. The ballast of claim 1 further comprising a control means for controlling the operation of said switch means.

16. The ballast of claim 15 wherein said control means comprises a manual switch.

17. The ballast of claim 15 wherein said control means comprises a motion detector.

18. The ballast of claim 15, wherein said control means comprises a sound detector.

19. The ballast of claim 1 wherein said switch means has a first and a second selectable switch position, said switch means being in said first switch position to connect said dimming winding in series with the lamp and said lamp winding, said switch means being in said second switch position to disconnect said dimming winding from the lamp and said lamp winding.

20. The ballast of claim 19 further comprising an electromagnetic dimming relay for controlling the switch position of said switch means.

21. The ballast of claim 20 wherein said dimming relay is energized to effect the positioning of said switch means in said first switch position, said dimming relay being deenergized to effect the positioning of said switch means in said second switch position.

22. The ballast of claim 20 wherein said dimming relay is energized to effect the positioning of said switch means in said second switch position, said dimming relay being deenergized to effect the positioning of said switch means in said first switch position.

23. The ballast of claim 20 further comprising a starting circuit means for effecting the energization of said dimming relay for a predetermined time after the a.c. power is applied to the ballast.

24. The ballast of claim 23 wherein said starting circuit comprises:

a starting contact connecting said a.c. power source with said dimming relay to effect the energization of said dimming relay when closed;

an electromagnetic starting relay for effecting the opening and closing of said starting contact, said starting relay being energized to effect the closing of said starting contact, said starting relay being deenergized to effect the opening of said starting contact; and a starting timer means operatively connected to the a.c. power source and said starting relay for effecting the energization and deenergization of said starting relay, said timer means effecting the energization of said starting relay upon the application of the a.c. power to the ballast, said timer means effecting the deenergization of said starting relay at a predetermined time after the a.c. power has been applied to the ballast.

25. The ballast of claim 24 wherein said dimming control means further comprises an energization means for effecting the energization and deenergization of said dimming relay, said energization means being operatively connected to the a.c. power source and to said dimming relay to effect the energization of said relay responsive to the detection of motion, sound, or manual stimulus, and to prevent the energization of said relay in the absence of the detection of motion, sound, or mechanical stimulus for a predetermined time.

26. The ballast of claim 20 wherein said dimming control means further comprises an energization means for controlling the energization and the deenergization of said dimming relay.

27. The ballast of claim 26 wherein said energization means comprises a detection means for detecting an external stimulus, said energization means being operatively connected to the a.c. power supply and to said dimming relay to effect the deenergization of said relay responsive to the detection of the external stimulus, and to effect the energization of said relay in the absence of the detection of the external stimulus.

28. The ballast of claim 26 wherein said energization means comprises a detection means for detecting an external stimulus, said energization means being operatively connected to the a.c. power supply and to said dimming relay to effect the energization of said relay responsive to the detection of the external stimulus, and to prevent the energization of said relay in the absence of the detection of the external stimulus.

29. The ballast of claim 28 wherein the external stimulus is one or more of the group consisting of motion, sound, and mechanical stimulus.

30. The ballast of claim 28 wherein said energization means further comprises a time delay means to effect the energization of said dimming relay for a predetermined time after the cessation of the detection of the external stimulus.

31. In a gaseous discharge lamp ballast comprising a core which magnetically couples (i) a primary winding adapted for receiving power from an a.c. power source, and (ii) a secondary winding adapted for providing power to the lamp at a substantially constant voltage, the improvement comprising:

switch means for selectively uncoupling a portion of said secondary winding to change the impedance of the ballast to thereby change the power provided to the lamp from (i) a power of about the rated power for the lamp effecting the illumination of the lamp in a bright mode to a power between about fifty percent and about sixty percent of the rated power effecting illumination of the lamp in a dim mode or (ii) a power between about fifty percent and about sixty percent of the rated power of the lamp effecting illumination of the lamp in a dim mode to a power of about the rated power of the lamp effecting illumination of the lamp in a bright mode.

32. In a gaseous discharge lamp ballast comprising:

(a) a magnetic core which couples (i) a primary winding connected to an a.c. power source, (ii) a secondary winding connected to the lamp, and (iii) a tertiary winding; and (b) means for selectively effecting illumination of the lamp in a dim mode;

the improvement wherein said means selectively connects or disconnects said tertiary winding from a series connection with the lamp and said secondary winding to change the power provided to said lamp from (i) about the rated power of the lamp effecting illumination of the lamp in a bright mode to a power less than the rated power of the lamp effecting illumination of the lamp in a dim mode or (ii) a power less than the rated power of the lamp effecting illumination of the lamp in a dim mode to about the rated power of the lamp effecting illumination of the lamp in a bright mode.

33. The ballast of claim 32 wherein the lower power is below about seventy-five percent of the rated power of the lamp.

34. The ballast of claim 33 wherein the lower power is between about fifty and sixty percent of the rated power of the lamp.

35. A dimming system comprising:

a gaseous discharge lamp suitable for sustained illumination in a blight mode and in a dim mode having a first and a second terminal;

a magnetic ballast comprising:

(a) a magnetic core, (b) a primary winding coupled to said core and being adapted for connection to an a.c. power source, and (c) a secondary winding coupled to said core, said secondary winding having a first and a second terminal, said first secondary winding terminal being connected to said first lamp terminal; and a dimming circuit comprising:

(a) a dimming winding coupled to said core, said dimming winding having a first terminal and a second terminal, said first dimming winding terminal being connected to said second lamp terminal; and (b) a dimming control means for selectively illuminating said lamp in a bright mode or in a dim mode, said dimming control means comprising:

(i) a dimming switch means for selectively connecting and disconnecting said dimming winding from a series connection with said lamp and said secondary winding, said dimming switch means having a first dimming switch contact comprising said second secondary winding terminal, a second dimming switch contact comprising said second dimming winding terminal, and a third dimming switch contact comprising said second lamp terminal, said dimming switch means having a first switch position wherein said first dimming switch contact is connected to said second dimming switch contact to thereby connect said dimming winding in series with said lamp and said lamp winding, said dimming switch means having a second switch position wherein said first dimming switch contact is connected to said third dimming switch contact to thereby connect said lamp in series with said secondary winding;

(ii) an electromagnetic dimming relay for controlling the switch position of said switch means; and (iii) an energization means for controlling the energization and the deenergization of said dimming relay, said energization means being operatively connected to the a.c. power supply and to said dimming relay to effect the energization of said relay responsive to an external stimulus, and to effect the deenergization of said relay when the external stimulus is absent for a predetermined time;

whereby said lamp is illuminated in a bright mode responsive to an external stimulus and remains illuminated in a bright mode until the stimulus is absent for a predetermined time, whereby said lamp is illuminated in a dim mode.

36. The dimming system of claim 35 wherein said switch means is in said first switch position to effect operation of said lamp in a bright mode.

37. The dimming system of claim 35 wherein said switch means is in said first switch position to effect operation of said lamp in a dim mode.

38. The dimming system of claim 35 wherein said dimming relay is energized to effect the positioning of said switch means in said first switch position, said dimming relay being deenergized to effect the positioning of said switch means in said second switch position.

39. The dimming system of claim 35 wherein said dimming relay is energized to effect the positioning of said switch means in said second switch position, said dimming relay being deenergized to effect the positioning of said switch means in said first switch position.

40. The dimming system of claim 35 further comprising a starting circuit for effecting the illumination of said lamp in a bright mode independent of the operation of said energization means for a predetermined time after the a.c. power is applied to said ballast, said starting circuit comprising:

a starting contact connecting the a.c. power source with said dimming relay to effect the energization of said dimming relay when closed;

an electromagnetic starting relay for effecting the opening and closing of said starting contact, said starting relay being energized to effect the closing of said starting contact, said starting relay being deenergized to effect the opening of said starting contact; and a starting timer means operatively connected to the a.c. power source and said starting relay for effecting the energization and deenergization of said starting relay, said timer means effecting the energization of said starting relay upon the application of the a.c. power to the ballast, said timer means effecting the deenergization of said starting relay at a predetermined time after the a.c. power has been applied to the ballast.

41. A magnetic ballast suitable for use with different HID lamp types operable over a wide range of voltages, said ballast comprising a core which magnetically couples (i) a primary winding adapted for receiving power from an a.c. power source and (ii) a secondary winding adapted for providing power at a substantially constant voltage to the HID lamp; and switch means for selectively uncoupling a portion of said secondary winding to vary the impedance of the ballast to thereby vary the power provided to the lamp to thereby effect the illumination of the lamp in either (i) a bright mode at about the rated power of the lamp or (ii) a dim mode at a power between about fifty percent and about seventy-five percent of rated power, said switch means operating responsive to the detection or non-detection of one or more external stimuli from the group consisting of sound and motion.

42. The ballast of claim 41 wherein the power provided to the lamp is reduced when said portion of said secondary winding is uncoupled to thereby effect operation of the lamp in a dim mode.

43. The ballast of claim 41 wherein the power provided to the lamp is raised when said portion of said secondary winding is uncoupled to thereby effect operation of the lamp in a bright mode.

44. A ballast suitable for operating a gaseous discharge lamp from an a.c. power source providing a substantially constant voltage to the lamp, said lamp operating in either a bright mode at about the rated power of the lamp or a dim mode at a power between about fifty percent to about seventy-five percent of the rated power of the lamp, said ballast comprising:

(a) a pair of a.c. power receiving terminals;

(b) a pair of lamp connection terminals;

(c) a magnetic core;

(d) a primary winding coupled to said core and being operatively connected to said power receiving terminals;

(e) a secondary winding coupled to said core and being operatively connected to said lamp connection terminals; and (f) dimming means for operatively disconnecting a portion of said secondary winding from said lamp connection terminals, said ballast providing to the lamp a power of about either the rated power of the lamp or a power between about fifty percent to about seventy-five percent of the rated power of the lamp, wherein said dimming means comprises a dimming switch operated in only a first or a second switch position; said dimming switch operated in said first switch position to operatively connect said secondary winding portion to said lamp connection terminals; said dimming switch operated in said second switch position to operatively disconnect said secondary winding portion from said lamp connection terminals.

45. The ballast of claim 44 further comprising means for selectively varying size of said secondary winding portion.

46. The ballast of claim 44 wherein said dimming means further comprises a dimming switch controller to selectively position said dimming switch, said controller positioning said switch in the first switch position responsive to an external stimulus, said controller positioning said switch in the second switch position when the external stimulus is absent for a predetermined time.

47. The ballast of claim 46 wherein said dimming means further comprises a dimming controller override means to position said dimming switch in the first switch position for a predetermined time after a.c. power is received at said power receiving terminals, said override means positioning said dimming switch independent of the presence of the external stimulus.

48. The ballast of claim 44 wherein said dimming means further comprises a dimming switch controller to selectively position said dimming switch, said controller positioning said switch in the second switch position responsive to an external stimulus, said controller positioning said switch in the first switch position when the external stimulus is absent for a predetermined time.

49. The ballast of claim 48 wherein said dimming means further comprises a dimming controller override means to position said dimming switch in the second switch position for a predetermined time after a.c. power is received at said power receiving terminals, said override means positioning said dimming switch independent of the presence of the external stimulus.

50. A method of illuminating a gaseous discharge lamp from an a.c. power source comprising the steps of:

providing a magnetic ballast, said ballast comprising a core which magnetically couples a primary winding and a secondary winding;

applying a.c. power to said primary winding;

illuminating the lamp by operatively connecting the lamp to said secondary winding; and varying the brightness of the lamp by removing a portion of said secondary winding from operative connection with the lamp to thereby change the power provided to the lamp while maintaining the voltage provided to the lamp substantially constant so that the lamp is illuminated at either a the brightness of the lamp operating at about the rated power for the lamp or about the brightness of the lamp operating at about the power below which the lamp will extinguish.

51. A method of varying the brightness of a magnetically ballasted gaseous discharge lamp comprising the steps of:

illuminating the lamp from a magnetic ballast comprising a magnetic core which couples (i) a primary winding adapted for connection to an a.c. power source, (ii) a secondary winding connected to the lamp, and (iii) a tertiary winding connected in series with the lamp and said secondary winding; and varying the brightness of the lamp by disconnecting said tertiary winding from the series connected lamp and secondary winding to thereby effect illumination of the lamp at either the brightness of the lamp operating at about the rated power of the lamp or the brightness of the lamp operating at between about fifty percent to about sixty percent of the rated power of the lamp.

52. The method of claim 51 further comprising the step of detecting an external stimulus, wherein the step of varying the brightness of the lamp is responsive to the detection or the cessation of detection of the external stimulus.

53. The method of claim 52 further comprising the step of providing a time delay, wherein said step of varying the brightness of the lamp is delayed for a predetermined time after the cessation of the detection of the external stimulus.

54. The method of claim 52 wherein the external stimulus is one or more of the group consisting of motion, sound, and mechanical stimulus.

55. The method of claim 52 further comprising the step of illuminating the lamp in a bright mode for a predetermined time after the lamp is illuminated.

56. The method of claim 55 further comprising the step of providing a time delay, wherein said step of varying the brightness of the lamp is delayed for a predetermined time after the cessation of the detection of the external stimulus.

57. A method of operating a gaseous discharge lamp from an a.c. power source comprising the steps of:

(a) providing a gaseous discharge lamp;

(b) ballasting said lamp from a magnetic ballast comprising a magnetic core which couples a primary winding and a secondary winding;

(c) providing a.c. power to said primary winding;

(d) illuminating said lamp by providing power at a substantially constant voltage to said lamp in series connection with said secondary winding; and (e) varying the power provided to said lamp by disconnecting a portion of said secondary winding from the lamp so that the power provided to the lamp is either a power of about the rated power of the lamp or a power of about fifty percent and about seventy-five percent of the rated power of the lamp.

58. A method comprising the steps of:

(a) providing a gaseous discharge lamp;

(b) providing a magnetic ballast comprising a magnetic core which couples primary, secondary, and tertiary windings;

(c) providing a switch means having a first and a second switch position, said first switch position connects said tertiary winding in series with said lamp and said secondary winding, said second switch position disconnects said tertiary winding from said series connected lamp and secondary winding;

(d) illuminating said lamp by providing a.c. power to said primary winding and positioning said switch means in said first switch position to provide power to said lamp from the series connected secondary and tertiary windings; and (e) varying the power provided to said lamp by positioning said switch means in either said first or said second switch position the power provided to the lamp being either a power of about the rated power of the lamp or a power of about fifty percent to about sixty percent of the rated power of the lamp.

59. The method of claim 58 further comprising the step of providing an electromagnetic relay, said relay being energized to effect the positioning of said switch means in said first switch position, said electromagnetic relay being deenergized to effect the positioning of said switch means in said second position.

60. The method of claim 58 further comprising the step of illuminating the lamp in a bright mode for a predetermined time after the lamp is illuminated.

61. The method of claim 58 further comprising the step of detecting an external stimulus, wherein said step of varying the power provided to said lamp is responsive to the detection or the cessation of detection of the external stimulus.

62. The method of claim 61 wherein said external stimulus is one or more from the group consisting of motion, sound, and mechanical stimulus.

* * * * *